US006250240B1

(12) United States Patent
Thiger et al.

(10) Patent No.: US 6,250,240 B1
(45) Date of Patent: Jun. 26, 2001

(54) WATER CRAFT HAVING VENTILATED PROPELLER

(75) Inventors: Hans Thiger, Enhorna; Pierre Thiger, Foreningsvagen 9, S-130 35, Ingaro, both of (SE)

(73) Assignee: Pierre Thiger (SE)

( * ) Notice: Subject to any disclaimer, the term of this patent is extended or adjusted under 35 U.S.C. 154(b) by 0 days.

(21) Appl. No.: 09/147,963

(22) PCT Filed: Sep. 24, 1997

(86) PCT No.: PCT/SE97/01608

§ 371 Date: Nov. 16, 1999

§ 102(e) Date: Nov. 16, 1999

(87) PCT Pub. No.: WO98/13256

PCT Pub. Date: Apr. 2, 1998

(30) Foreign Application Priority Data

Sep. 24, 1996 (SE) ..... 9603487

(51) Int. Cl.[7] ..... B63B 1/00
(52) U.S. Cl. ..... 114/61.12; 114/271
(58) Field of Search ..... 114/61.1, 61.12, 114/61.13, 271

(56) References Cited

U.S. PATENT DOCUMENTS 5,171,175 12/1992 Buzzi .

FOREIGN PATENT DOCUMENTS 9601020-2 9/1997 (SE) .

*Primary Examiner*—Jesus D. Sotelo
(74) *Attorney, Agent, or Firm*—Larson & Taylor, PLC

(57) ABSTRACT

Improvement in water craft of single-hull type or multi-hull type and having a drive apparatus or a hub (7) carrying a ventilated propeller (6) of so called "surface piercing" type, in which the drive or the hub (7) with the surface piercing propeller (6) is mounted close to the end of a fin like hull body (4), or a fin like part of an integral hull body, preferably having an elongated torpedo like (11) bottom body, and which fin like body (4) is so deep that the propeller (6), at all speeds of the ship, operates entirely under water, and in which the rear end of the conical fin body (4, 11) extends transversally to the longitudinal direction of the ship and has an average width in this direction which is substantially less than the diameter of the propeller (6). The torpedo like body (11) may have a front cone which can be expelled some distance in front of the torpedo body (11).

21 Claims, 4 Drawing Sheets

WATER CRAFT HAVING VENTILATED PROPELLER

FIELD OF THE INVENTION

The present invention relates to an improvement in water craft of single-hull type or multi-hull type and equipped with one or more ventilated propellers of so called "surface piercing propeller" type, especially water craft intended to be driven at high speeds over water, for instance speeds of at least 20–30 knots, preferably up to 50 knots or more.

BACKGROUND OF THE INVENTION

Normally propellers of surface piercing propeller type are arranged and mounted so that the propeller, upon driving the boat in a water surface planing position, operates with at least 50% of the driving surface above the sea water surface or otherwise in a corresponding gas or air flow. Propellers of this type exhibit many advantages over conventional propeller arrangements, where the propeller as a complete operates under water. Among other things, the fact that the propeller in part operates in the air involves the advantage that there will be very little, if any, cavitation, and that the propeller, in spite exhibiting very strong propulsion force, is subjected to very small, if any, cavitation damages.

In some respects, however, a surface piercing propeller also can give rise to some problems. Since the propeller blades to a great part of their revolution operates in air there will appear a lifting force when the propeller, after having rotated in the air, hits the water surface. The propeller blades thereby hit the water surface with a substantially horizontal force. Said lifting force can amount even up to 30% of the propulsion force of the propeller, and this will reduce the effective propulsion ability of the propeller.

Since only half the propeller operates under water the impact force of the propeller against the water surface also will make the propeller shaft be subjected to a certain unevenly distributed load which may cause problems with wear of bearings, vibrations, and in the worst case, rupture of the propeller shaft.

There has been a desire to make it possible to make use of the favourable properties of surface piercing propellers by using such surface piercing propellers also for propulsing ships in the cases where the propeller, even at full speed of the ship, operates entirely under water. This, however, has not met with success depending on a problem which has been difficult to solve:

Since the propeller operates entirely under the water surface there will be a strong sub pressure against the surface of the propeller facing forwardly and this leads to cavitation and cavitation damages depending therefrom. Cavitation damages can generally be compared with corrosion damages. For eliminating such problem it is necessary that the surface piercing propellers are ventilated, so that the sub pressure against front surfaces of the propeller blades can be unloaded at each individual revolution of the propeller, and whereby air bubbles, which tend to appear at the (front) suction side of the propeller in case of cavitation, are removed. The ventilation also should be such that the propeller blades, during the greatest part of their revolution, for instance up to 90% of their revolution, are allowed to operate in the water, whereas said propeller blades, during a very little part is its revolution, operate in the air. In this last mentioned case the sub pressure on the suction side of the propeller blade is unloaded, and this strongly reduces the risk of appearance of cavitation.

The ventilation of a surface piercing propeller, which operates entirely under water has, in turn, caused special problems.

SUMMARY OF THE INVENTION

According to the invention the drive, or the hub of the water craft, with the surface piercing propeller is mounted adjacent the bottom of a fin like hull body, or a part of a complete hull body comprising a fin like hull part extending down towards the propeller hub, and whereby said hull part has a rear side extending transversally to the longitudinal direction of the water craft and has an average width in said direction which is substantially less than the propeller diameter. In the vertical direction the transversely cut conical fin body should extend at an angle upwards-forwards from the propeller centre of not more than 45° to an angle upwards-rearwards from the propeller of not more than 45°. While propulsing the water craft forwards at a medium to high speed the fin like hull part creates a cone shaped air column down to the propeller hub, and behind the propeller a successively reduced cone shaped air chamber. Said air column down to the propeller centre should be as narrow as possible, and preferably it should not cover more than 10% of the propulsion surface of the propeller, at a maximum. It is very important that said air column at the propeller hub is so narrow as possible. When the propeller rotates each propeller blade passes once per revolution through said air column, whereby the sub pressure against the propeller blade is practically completely unloaded.

Tests in water have proved that a water craft of the described type having a surface piercing propeller and having the above described V-shaped hull fin does not give such cavitation sling of air which is normally seen after conventional water craft having sub-water driven propellers giving a high propulsion force.

Both sides of the fin like sub water body or hull body portion preferably are concave and can have such arc shape that the tangent of the sides of the fin body adjacent the propeller hub is 0°, that is that said sides extend in the vertical direction. An angle between the propeller centre and the contact point of the hull body with the sea water surface, when the water craft is running at medium to high speed, can for instance be ±45°, at a maximum.

In a special embodiment of the invention the drive or hub is formed like a type of torpedo having a circular cross section, which torpedo has, at its rear end, a propeller, and the length of which is about 10–20 times the greatest diameter thereof, most preferably about 12–16 times the torpedo diameter. The front end of the fin with the torpedo portion can preferably meet the ordinary hull body portion in the form of a clipper stem like part, that is in a kind of C-formation.

In a still further preferred embodiment of the invention the torpedo like body mounted under the ordinary hull of the water craft is formed as a housing for the drive engine, for instance the gas turbine, and possibly also for the fuel tank, whereby the centre of gravity of the water craft will be placed lower than is possible in ordinary water craft, in which the drive engine is normally mounted inside the hull above, or at least close, to the sea water level. Therefore the torpedo with the engine acts as a type of heavy keel for the water craft.

A further advantage with the such an apparatus also is that the propeller can be mounted with the propeller shaft extending horizontally, meaning parallelly the sea water level when the water craft is running at cruising speed. This gives an optimum good propulsion ability, in particular since the propeller can be mounted with the thrust surfaces thereof at an optimum angle in relation to the sea and the running, water craft.

In a still further embodiment of the invention the front end of the torpedo like submarine body, which is opposite to the propeller end, is formed with a streamline cone which can be extended some distance thereby forming an annular space between the torpedo body and the front cone, in which annular space air band/or exhaust gases from the drive engine can be pressed out, which air forms an air jacket round the torpedo body, which air jacket extends as far as to, and past the propeller thereby ventilating same. By expelling the front cone more or less in relation to the torpedo body there is obtained a more narrow or more widened air/gas jacket. Thereby the ventilation of the propeller can be adjusted to an optimum, adapted to different speeds and/of different loading ot the water craft.

Thus, the invention relates to an improvement in water craft of single-hull or multi-hull type and having a ventilated propeller of so called "surface piercing propeller" type, in particular water craft intended to run at high speeds in the sea, which makes it possible to use a surface piercing propeller in spite that the entire propeller is located underneath the water surface, in which the propeller introduces a minimum lifting force during its rotation, and in which the propeller only introduces a side force which can be made neglectible, or can even be nil, and can be inhibited by using twin mounted propellers, which is formed with a downwards tapering fin like hull portion, or a keel type body, arranged to create an air column down to, or round the propeller hub and which provides an unloading of the sub pressure against the propeller blades for each single revolution thereof, which is formed so that the propeller shaft can be mounted with the axis thereof extending horizontally, AND which is formed so that the can be created a differently extensive flow or air or gas past the propeller.

Further characteristics and advantages of the invention will be evident from the following detailed specification in which reference will be made to the accompanying drawings.

DETAILED DESCRIPTION OF THE PREFERRED EMBODIMENTS OF THE INVENTION

Figure 1:
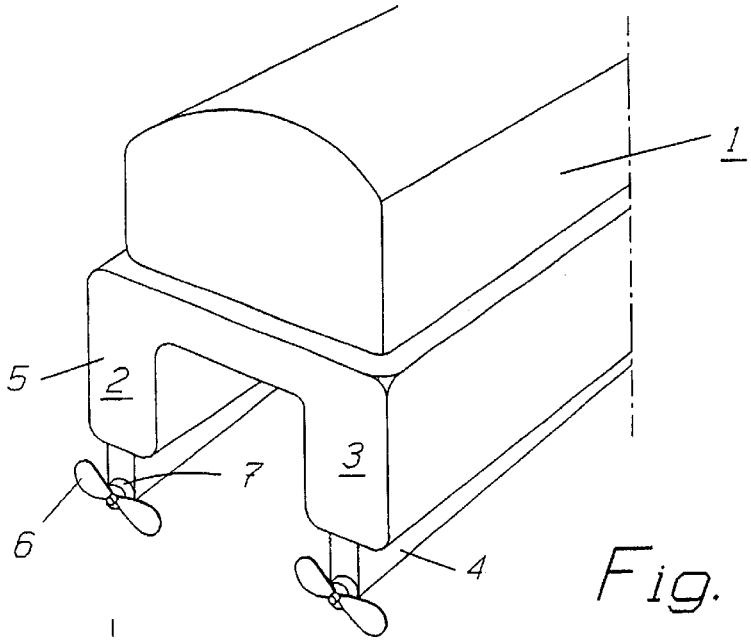
FIG. 1 is a diagrammatic perspective view obliquely from behind of a water craft according to the invention having a special bottom shape.
Figure 2:
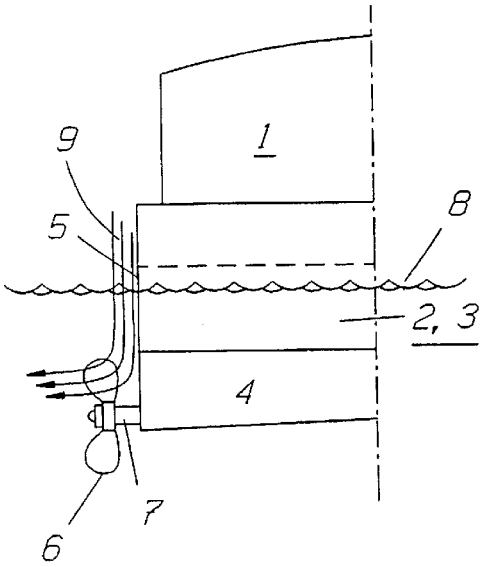
FIG. 2 is a side view of a little portion of the stern of the water craft according to FIG. 1.
Figure 3:
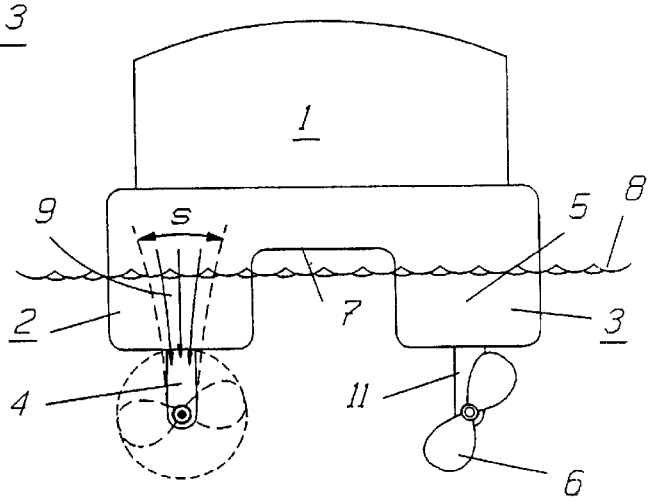
FIG. 3 shows the same water craft straight from behind.

In FIGS. 1, 2 and 3 there are shown a water craft having a specially designed bottom, which is arranged to make it possible to ventilate propellers of surface piercing type. The water craft, which, in this case, is shown as a catamaran hull, has a superstructure 1, a port side hull 2 and a starboard hull 3. At the bottom surface of each hull 2, 3 there is a type of fin body 4 which, in the illustrated case, has substantially plain parallel sides. The flat stern 5 of the ship is cross cut perpendicularly to the longitudinal direction of the ship and it is substantially vertical. At the bottom of each hull there is shown a propeller 6 which is beared in a hub or in a drive housing 7. The propeller operates entirely underneath the water surface 8 at all speeds of the water craft (ship).

Depending on this shape of hull 2, 3 and stern 5 there is formed such a flow of water past the propeller 6 that air is sucked down towards the centre of the propeller 6 in a narrow, column like air flow 9 as indicated in FIGS. 2 and 3. The flow of air can form a slightly conical angle downwards having such length in the longitudinal direction of the ship that each propeller blade passes the air flow in its uppermost position, preferably in a sector of the rotation circle of 5–30°. In many cases it is considered a disadvantage that air is sucked down to the propeller, but for so called "surface piercing propellers" this is, on the contrary, a great advantage. For surface piercing propellers it is necessary that the propeller is ventilated. Therefore the bottom structure of the hull should be such that the, or each propeller is ventilated in a sector s, see FIG. 3, of for instance 5–30° of the rotation circle of the propeller, and this is provided in that the hull is formed with a lower fin 4, in that the ship has a flat, substantially vertical, or up to ±45° inclined stern 5, and in that the propeller, at cruising speed and higher speeds of the water craft, is located on a predetermined level underneath the sea water level, which level is reached by the downwards-rearwards sucked flow of air, and which remains on a predetermined distance rearwards of the stern.

Figure 4:
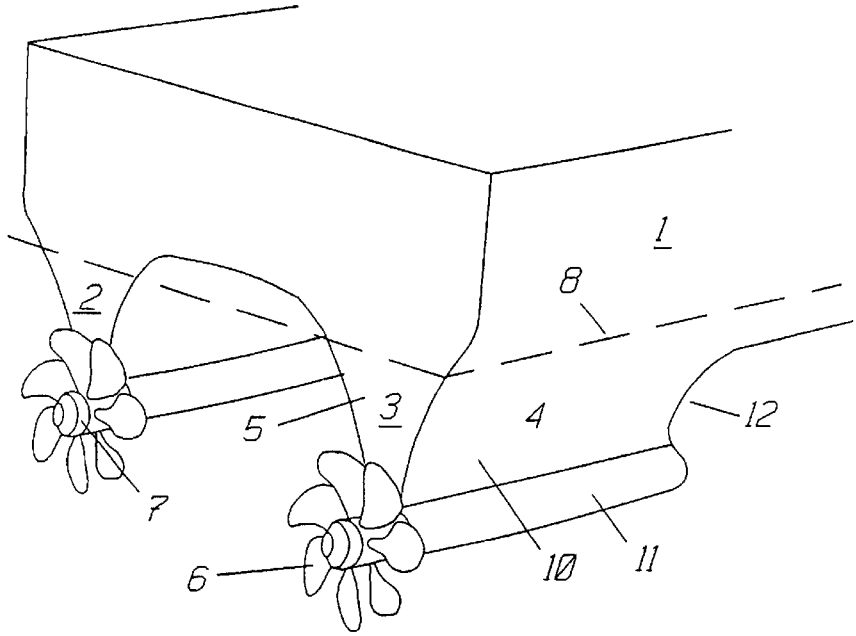
FIG. 4 shows an alternative embodiment of a fin like hull part according to the invention in a catamaran type water craft, seen obliquely from behind, and FIG. 5 diagrammatically illustrates the function of the ventilation of the propeller in four successive projections.

In FIG. 4 is shown a hull fin 4 which can be made integral with the hull, or which can be formed as a separate unit which is mounted against the bottom of an available water craft. The fin is formed as a fin body which tapers downwards in a bow form. The fin is so deep that the propeller operates entirely under the sea water level 8, even at medium high to very high speeds of the ship. The average width of the fin is substantially less than the diameter of the propeller 6. The tangent of the bow formed fin side 10 becomes less in the direction downwards and approaches, or is equal to 0° at the propeller hub 7, in other words so that the said tangent is thereby vertical. The angle between the propeller centre and the points where the fin sides 10 meet the sea water surface 8 may vary from about ±10° to about ±45°, as calculated from a vertical line through the propeller centre. Also in the embodiment shown in FIGS. 4 and 5 the stern of said fins extends perpendicularly to the longitudinal direction of the ship. In the vertical direction said stern can extend vertically.

Figure 9:
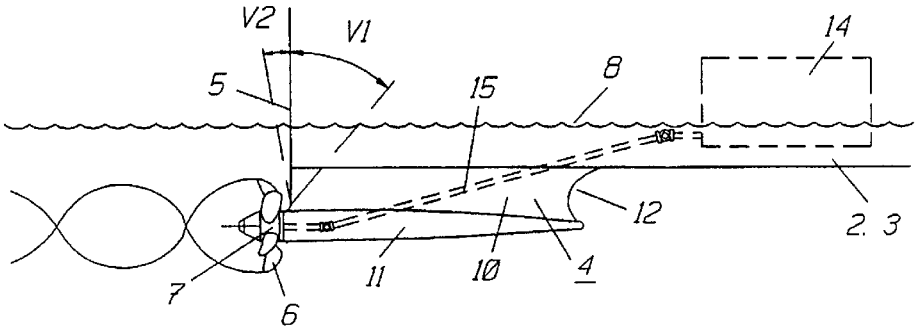
FIG. 9 is a side view of a part of a hull including a torpedo like hull part belonging to a water craft according to the invention.

As indicated in FIG. 9 the stern of the fin 4 may, however, extend at an angle V1 upwards-forwards from the propeller hub 7 of up to 45°. It is also possible to make the stem 5 extend upwards-rearwards at an angle V2 of up to 45°, supposing there is free space for the propeller to rotate.

The fin 4 should have its smallest width adjacent the hub 7. For best function the hub is extended forwardly to form a torpedo like body 11, which torpedo body is elongated in the forward direction a distance corresponding to 10–20 times, or preferably 12–16 times the diameter of the torpedo body. The torpedo body 11 is levelled in the longitudinal direction of the water craft (ship) so as to be parallel to the sea water level 8 at cruising speed, and up to full speed, forwards of the water craft. The torpedo body 11 may have such streamline as to give an optimum little water flow resistance. At the front end the fin meets and is connected to the ship hull in a clipper stem like formation or a C-formation 12.

Figure 5:
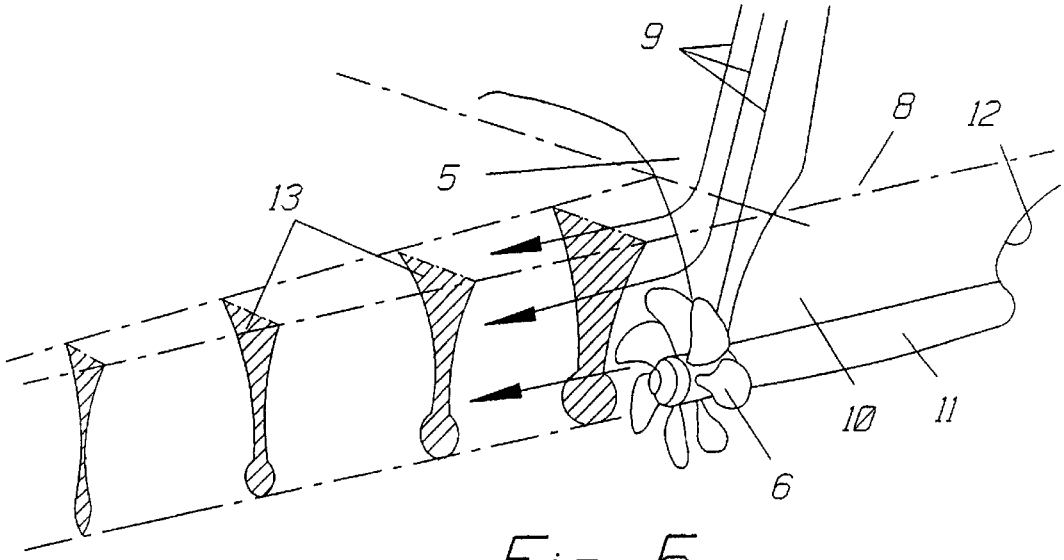

When the ship is moved at medium to high speeds a column of air 9 is sucked down towards the propeller and the propeller hub 7. The air column ought to be as narrow as possible in order not to unnecessarily reduce the propulsion capacity of the propeller(s). Even a very narrow air column 9 provides the intended ventilation and unloading of the sub pressure of the propeller blades when said blades rotate past the air column. The air column 9 leaves an air shadow 13, see FIG. 5, behind the ship which is moving forwardly, which air shadow is successively diminished and finally disappears behind the moving ship. With the shape of the fin 4 and the torpedo body 11, as shown in FIGS. 4 and 5, the air shadow has the shape of key hole turned upside down, as diagrammatically indicated in four hatched projections in FIG. 5.

When the propeller rotates each propeller blade operates, during the greatest part of its revolution, in water, preferably to more than 90% of its revolution. During the operation in water there is developed a successively increased pressure force against the rearwardly facing side of the propeller blade, and correspondingly there is created a successively increased sub pressure against the forwardly facing side of the propeller blades, that is against the suction side of the propeller blades. Such sub pressure should cause cavitation if there was no ventilation of the propeller, as shown with the air column 9, but as soon as the propeller blade enters the air column 9 said sub pressure against the propeller blade is unloaded. When the propeller blade thereafter enters the water aside of the air column a sub pressure once again starts building up on the forwardly facing side, the suction side, of the propeller blade, and correspondingly a cycle of sub pressure and unloading of such sub pressure is repeated.

When the propeller blade, after having passed the air column 9, step by step enters the water there is obtained a certain pressure in the transversal direction. Such side pressure is of neglectible strength and does not significantly influence the propulsion ability of the propeller, especially not in case the water craft is formed with twin mounted, counter rotating propellers.

The drive arrangement including the ventilated propeller arrangement and the fin like body 4 can be formed as an integral part of the ship hull, but it can, alternatively, also be formed as a separate unit which is mounted against the bottom of a hull or a hull part.

Figure 6:
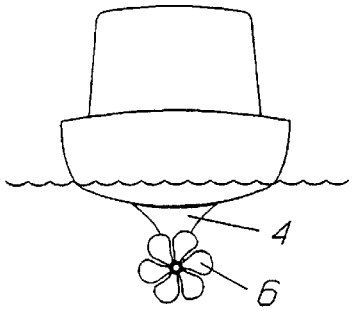
FIG. 6 shows a boat of single hull type formed with a fin like accessory part according to the invention.

In FIG. 6 there is shown a single-hull boat equipped with a drive arrangement according to the invention having a fin type keel 4 and a surface piercing propeller 6. In the illustrated case the entire fin type drive arrangement is formed as a separate unit which, in any suitable way, is secured to the boat hull.

Figure 7:
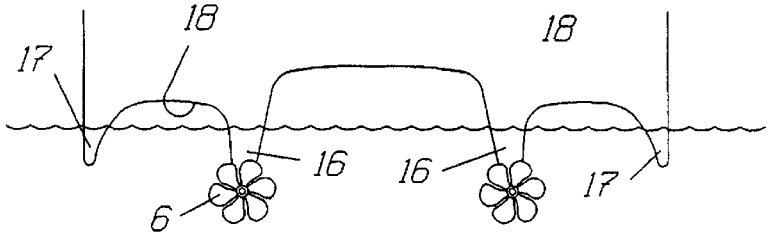
FIG. 7 correspondingly shows the invention applied to a catamaran type "Surface Effect Ship"(SES-ship)

FIG. 7 shows a catamaran (quadramaran) of Surface Effect Ship (SES) type in which each of the two intermediate hulls 16 is formed with a surface piercing propeller 6, and in which, at cruising speed of the water craft, there is formed an air filled side keel chamber 18 between each pair of an intermediate hull 16 and the outer hull 17, which side keel chamber 18 acts as a type of air support cushion which carries and stabilises the ship when moved at medium to high speed.

Figure 8:
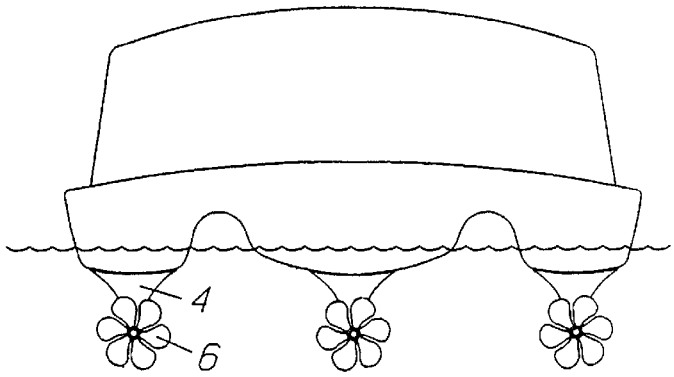
FIG. 8 shows the invention mounted on a trimaran type ship.

FIG. 8 shows a rather conventional trimaran which is formed with three fin bodies 4 and belonging torpedo bodies and is formed with surface piercing propellers 6.

In FIG. 9 there is shown a water craft according to the invention, seen in a side view. It is evident that the fin body 4 extends horizontally. By the bow formed (sinus formed) lines 19 behind the propeller is indicated the propeller movement in the sea water. It is also indicated that the drive engine 14 can be mounted at any suitable place in the ordinary hull and can transmit the engine power to the propeller via en angle shaft 15, electrically or hydraulically, the end part of which connected to the propeller 6 is substantially horizontal.

Figure 10:
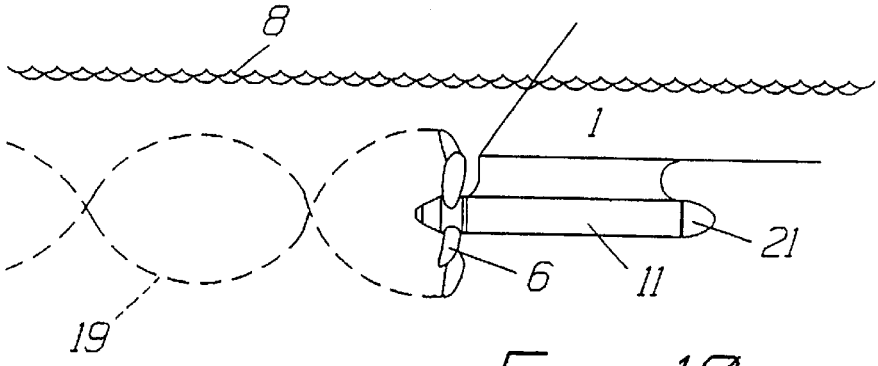
FIG. 10 shows an alternative embodiment of a torpedo like hull extension.
Figure 11:
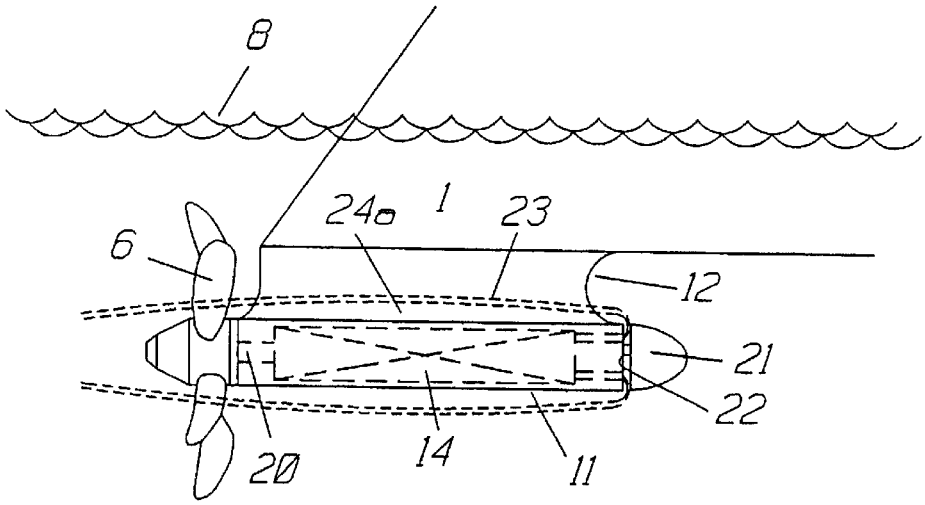
FIGS. 11 and 12 shows the function of the torpedo extention according to the invention.
Figure 12:
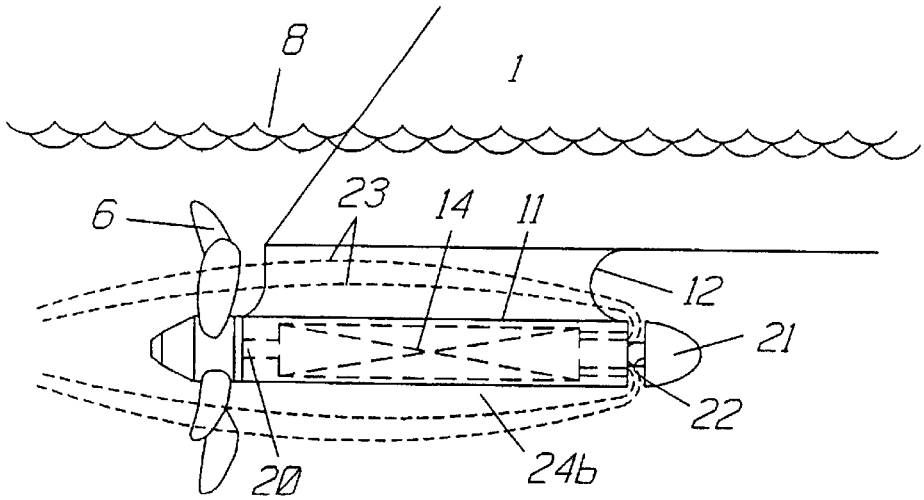

In FIGS. 10–12 there is shown a still further preferred embodiment of the invention, in which the torpedo like body mounted under the ordinary hull of the water craft is formed as a housing for the drive engine 14, for instance the gas turbine, and possibly also for the fuel tank, whereby the centre of gravity of the water craft will be placed lower than is possible in ordinary water craft, in which the drive engine is normally mounted inside the hull 1 above, or at least close, to the sea water level 8. Therefore the torpedo with the engine acts as a type of gravity force keel for the water craft.

A further advantage with the such an apparatus also is that the propeller 6 can be mounted with the propeller shaft 20 extending horizontally, meaning parallelly the sea water level 8 when the water craft is running at cruising speed. This gives an optimum good propulsion ability, in particular since the propeller can be mounted with the thrust surfaces thereof at an optimum angle in relation to the sea and the running water craft.

In a still further embodiment of the invention the front end of the torpedo like submarine body 11, which is opposite to the propeller end, is formed with a streamline cone 21 providing an optimum water flow past the submarine body. In an embodiment of the invention said front cone 21 is formed and connected to the torpedo body 11 so that it can be extended some distance thereby forming an annular space 22 between the torpedo body 11 and the front cone 21, in which annular space air and/or exhaust gases 23 from the drive engine can be pressed out, which air forms an air jacket 24*a*, resp. 24*b* round the torpedo body 11, which air jacket extends as far as to, and past the propeller 6 thereby ventilating same. By expelling front cone 21 more or less in relation to the torpedo body there is obtained a more narrow 24*a* or more widened air/gas jacket 24*b*. Thereby the ventilation of the propeller can be adjusted to an optimum, adapted to different speeds and/of different loading ot the water craft.

REFERENCE NUMERALS 1 superstructure
2 hull
3 hull
4 fin
5 stern
6 propeller
7 hub -continued

| REFERENCE NUMERALS |
|---|
| 8 water level |
| 9 air flow |
| 10 fin side |
| 11 torpedo body |
| 12 clipper type stem |
| 13 air shadow |
| 14 engine |
| 15 angle shaft |
| 16 intermediate hull |
| 17 outer hull |
| 18 side keel chamber |
| 19 sinus lines (propeller) |
| 20 propeller shaft |
| 21 cone |
| 22 annular space |
| 23 air, exhaust gases |
| 24 air space (24a, 24b) |

What is claimed is:

1. A water craft having at least one hull and a drive apparatus carrying a ventilated propeller, the drive apparatus being mounted close to the end of a fin like hull body, the fin like hull body extending along a substantial part of the water craft and being sufficiently deep that the propeller, at all speeds of the craft, operates entirely under water level, the fin like hull body extending in a transverse direction to a longitudinal direction of the craft and having an average width in the transverse direction substantially less than a diameter of the propeller and wherein the drive apparatus has smaller diameter than a width of the fin like hull body at the upper edge of the drive apparatus, and wherein a drive body is extended to form an elongated streamline torpedo like body.

2. A water craft according to claim 1, wherein a rear end of the fin like hull body is cross cut and extends vertically upwards.

3. A water craft according to claim 1, wherein the fin like hull body has concave sides, the tangents of said concave sides, at the drive apparatus, being as low as 0°.

4. A water craft according to claim 3, wherein the shape of the fin like hull body is such that the angle between a center of the propeller and a point where a set of concave sides of the fin like hull body meet the water surface is not more than 45° as seen in both directions from a vertical line through the propeller center.

5. A water craft according to claim 1, wherein the drive body is 10–20 times longer than the greatest diameter thereof.

6. A water craft according to claim 5 wherein the drive body is 12–16 times longer than the greatest diameter thereof.

7. A water craft according to claim 1, wherein the fin like hull body, at a front end thereof, meets a bottom of a main hull of the ship in a clipper stem formation.

8. A water craft according to claim 1, wherein the drive body is mounted so as to extend substantially parallel to the water level when the water craft is moving at cruising speed, and wherein the drive body includes at the front end, a streamline cone.

9. A water craft according to claim 8, wherein the streamline cone is mounted so that it can be extended some distance forwards from the drive body thereby providing an annular space between the drive body and the streamline cone, air or exhaust gases being pressed out in the annular space the air or exhaust gases forming an air jacket along the drive body and past the propeller of the moving water craft.

10. A water craft according to claim 1, wherein the drive body carries a drive engine and the fulel tank for said drive engine.

11. A water craft according to claim 10, wherein the drive engine is mounted so as to be connected to the propeller over a straight propeller shaft extending substantially parallel to the water level at cruising speed of the water craft.

12. A water craft according to claim 1, wherein the fin like hull body comprises a separate unit arranged to be mounted to the bottom of a single hull boat.

13. A water craft according to claim 1 wherein the fin like hull part has a conical shape.

14. A water craft according to claim 13, wherein the shape of the fin like hull body and the suction action of the propeller act in conjunction to form a conical air column along the exterior of the water craft hull to the propeller when the craft is moved at medium to high speed, and wherein a successively reduced conical air chamber is formed behind the propeller.

15. A water craft according to claim 14 wherein the fin like hull body is formed so that the air column is sufficiently narrow, so as to occupy a surface area of no greater than 10% of the revolution surface of the propeller.

16. A water craft according to claim 1 wherein the drive apparatus comprises a propeller hub.

17. A water craft according to claim 1 wherein a rear end of the fin like hull body extends at an angle upwards-forwards from the propeller of not more than 45° to an angle upwards-rearwards from the propeller of not more than 45°.

18. A water craft according to claim 1, wherein the fin like hull body comprises a separate unit arranged to be mounted against each hull of a multi hull ship.

19. A water craft having at least one hull and a drive carrying a ventilated propeller, the drive being mounted close to the end of a fin like hull body, the fin like hull body extending along a substantial part of the water craft and being sufficiently deep that the propeller, at all speeds of the craft, operates entirely under water level, the fin like hull body extending in a transverse direction to a longitudinal direction of the craft and having an average width in the transverse direction substantially less than a diameter of the propeller, and wherein the fin like hull body has concave sides, the tangents of said concave sides, at the drive apparatus, being as low as 0°.

20. A water craft having at least one hull and a drive apparatus carrying a ventilated propeller, the drive apparatus being mounted close to the end of a fin like hull body, the fin like hull body extending along a substantial part of the water craft and being sufficiently deep that the propeller, at all speeds of the craft, operates entirely under water level, the fin like hull body extending in a transverse direction to a longitudinal direction of the craft and having an average width in the transverse direction substantially less than a diameter of the propeller, and wherein the drive apparatus comprises a propeller hub.

21. A water craft having at least one hull and a drive apparatus carrying a ventilated propeller, the drive apparatus being mounted close to the end of a fin like hull body, the fin like hull body extending along a substantial part of the water craft and being sufficiently deep that the propeller, at all speeds of the craft, operates entirely under water level, the fin like hull body extending in a transverse direction to a longitudinal direction of the craft and having an average width in the transverse direction substantially less than a diameter of the propeller, and wherein a rear end of the fin like hull body extends at an angle upwards-forwards from the propeller of not more than 45° to an angle upwards-rearwards from the propeller of not more than 45°.

* * * * *